US009098056B2

(12) United States Patent
Ohashi et al.

(10) Patent No.: US 9,098,056 B2
(45) Date of Patent: Aug. 4, 2015

(54) IMAGE FORMING APPARATUS

(71) Applicant: KYOCERA Document Solutions Inc., Osaka (JP)

(72) Inventors: Hiroaki Ohashi, Osaka (JP); Masahiro Kashimoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/257,804

(22) Filed: Apr. 21, 2014

(65) Prior Publication Data

US 2014/0348536 A1 Nov. 27, 2014

(30) Foreign Application Priority Data

May 23, 2013 (JP) ..... 2013-109224

(51) Int. Cl.
*G03G 15/00* (2006.01)
*G03G 21/16* (2006.01)

(52) U.S. Cl.
CPC ..... *G03G 21/1647* (2013.01); *G03G 2221/163* (2013.01); *G03G 2221/166* (2013.01); *G03G 2221/1684* (2013.01)

(58) Field of Classification Search
CPC ..... G03G 21/1633; G03G 21/1647; G03G 21/1623; G03G 21/185
USPC ..... 399/110
See application file for complete search history.

(56) References Cited

U.S. PATENT DOCUMENTS 8,761,639 B1 * 6/2014 Leemhuis et al. ..... 399/120
2007/0160384 A1 * 7/2007 Sakurai et al. ..... 399/110
2008/0107445 A1 5/2008 Yamaguchi ..... 399/111
2012/0057890 A1 * 3/2012 Takuma et al. ..... 399/53
2012/0155913 A1 * 6/2012 Jung ..... 399/92
2012/0163877 A1 * 6/2012 Kikuchi et al. ..... 399/262
2012/0219318 A1 * 8/2012 Yoshida et al. ..... 399/110
2012/0219413 A1 * 8/2012 Charest ..... 415/213.1

FOREIGN PATENT DOCUMENTS

JP 2008-116798 A 5/2006
JP 2011-191603 A 9/2011

OTHER PUBLICATIONS

Machine translation of JP 2011-191603 A, publication date: Sep. 29, 2011.*

* cited by examiner

*Primary Examiner* — Walter L Lindsay, Jr.
*Assistant Examiner* — Frederick Wenderoth
(74) *Attorney, Agent, or Firm* — Stein IP, LLC

(57) ABSTRACT

An image forming apparatus includes an image carrying member unit, a development device, a developer collection mechanism and a unit support tray. The developer collection mechanism is arranged on a downstream side in a first direction where the development device and the image carrying member unit are fitted into the main body of the image forming apparatus and the toner discharge portion of the image carrying member unit is coupled to the developer collection mechanism. The unit support tray is provided such that the unit support tray can be moved horizontally in the first direction and a second direction where the development device and the image carrying member unit are removed from the main body of the image forming apparatus; the unit support tray is moved in the first or second direction such that the toner discharge portion and the developer collection mechanism are coupled or the coupling is cancelled.

12 Claims, 16 Drawing Sheets

IMAGE FORMING APPARATUS

CROSS-REFERENCE TO RELATED APPLICATIONS

This application is based upon and claims the benefit of priority from the corresponding Japanese Patent Application No. 2013-109224 filed on May 23, 2013, in the Japanese Patent Office. All disclosures of the document(s) named above are incorporated herein by reference.

BACKGROUND OF THE INVENTION

The present disclosure relates to an image forming apparatus such as a copying machine, a printer or a facsimile machine, and more particularly relates to an image forming apparatus that includes a development device and an image carrying member unit which are removably fitted to the image forming apparatus.

In a conventional image forming apparatus, when the number of sheets printed reaches a predetermined number of sheets (for example, several tens of thousands of sheets) due to the life of a photoconductive drum (image carrying member), it is necessary to replace a drum unit (image carrying member unit) including the photoconductive drum. It may be necessary to perform the maintenance or the replacement of a development device arranged adjacent to the drum unit.

Hence, various types of mechanisms that can easily insert and remove the photoconductive drum and the development device are devised; for example, there is known a configuration in which a process cartridge (image formation unit) where a photoconductive drum and a development device are formed integrally is removable from the main body of the image forming apparatus.

There is also known an image forming apparatus having a roller contact/separation mechanism in which after a development device is fitted to the main body of the image forming apparatus, as a holder member (drum locating unit) to which a locating plate for locating the drum shaft of a photoconductive drum is fitted is closed, a development roller is brought into contact with the photoconductive drum, and as the holder member is opened, the development roller is retracted from the photoconductive drum, with the result that when a drum unit or the development device is replaced, the photoconductive drum and the development roller are prevented from being scratched.

SUMMARY OF THE INVENTION

According to one aspect of the present disclosure, there is provided an image forming apparatus including an image carrying member unit, a development device, a developer collection mechanism and a unit support tray. The image carrying member unit includes an image carrying member, a cleaning device that removes a toner left on the image carrying member and a toner discharge portion that discharges the toner from the cleaning device and is arranged removably with respect to the main body of the image forming apparatus. The development device includes a developer carrying member that supplies the toner onto the image carrying member and is arranged adjacent to the image carrying member unit and removably with respect to the main body of the image forming apparatus. The developer collection mechanism is arranged on a downstream side in a first direction in which the development device and the image carrying member unit are fitted into the main body of the image forming apparatus and the toner discharge portion is coupled to the developer collection mechanism. The unit support tray is provided such that the unit support tray can be moved horizontally in the first direction and a second direction in which the development device and the image carrying member unit are removed from the main body of the image forming apparatus and individually and removably supports the image carrying member unit and the development device. The unit support tray is moved in the first direction such that the toner discharge portion and the developer collection mechanism are coupled whereas the unit support tray is moved in the second direction such that the coupling between the toner discharge portion and the developer collection mechanism is cancelled.

Further other objects and specific advantages of the present disclosure will become further apparent from the description of an embodiment discussed below.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
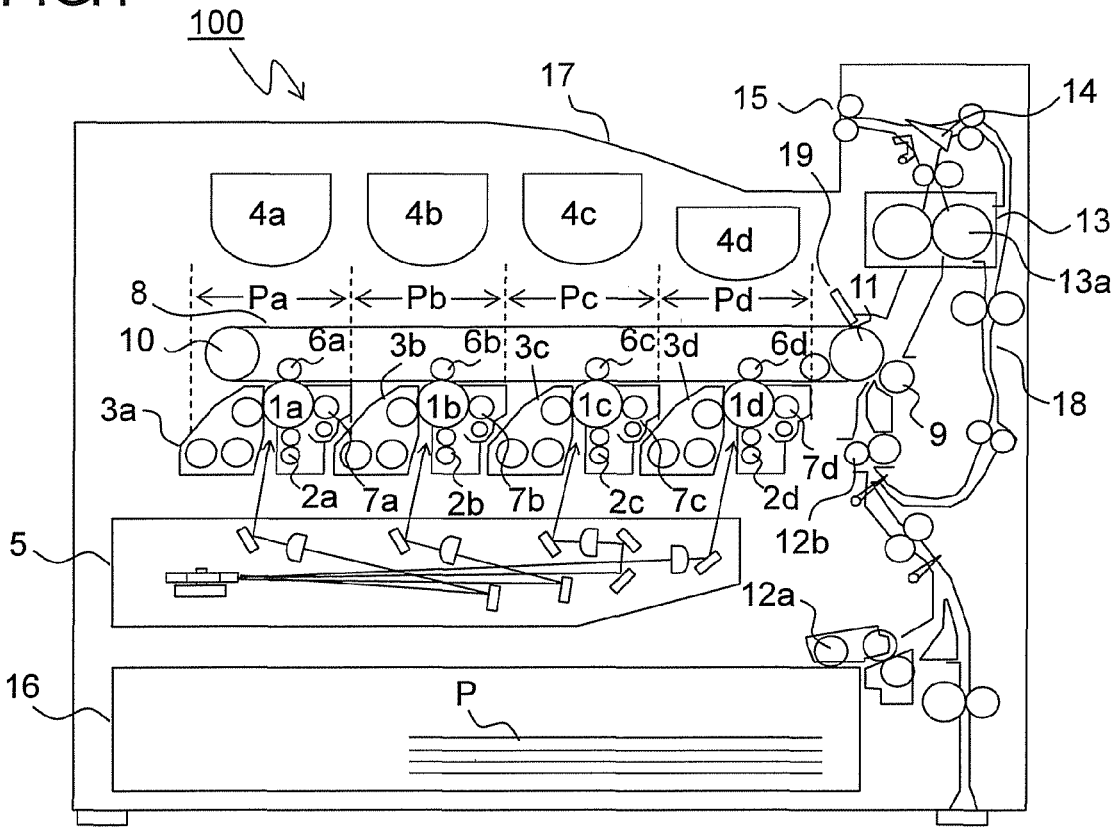
FIG. 1 is a schematic cross-sectional view showing an internal configuration of an image forming apparatus 100 according to an embodiment of the present disclosure.

An embodiment of the present disclosure will be described below with reference to accompanying drawings. FIG. 1 is a cross-sectional view showing a schematic configuration of an image forming apparatus 100 according to the embodiment of the present disclosure. In the present embodiment, the image forming apparatus 100 is formed with a quadruplicate tandem-type color printer in which four photoconductive drums 1*a*, 1*b*, 1*c* and 1*d* corresponding to four different colors (magenta, cyan, yellow and black) are arranged parallel to perform image formation.

Within the main body of the image forming apparatus 100, four image formation portions Pa, Pb, Pc and Pd are sequentially arranged from the left side in FIG. 1. These image formation portions Pa to Pd are provided according to images of the four different colors (magenta, cyan, yellow and black), and the individual images of magenta, cyan, yellow and black are formed sequentially in the steps of charging, exposure, development and transfer.

In these image formation portions Pa to Pd, the above-described photoconductive drums 1*a* to 1*d* which carry visual images (toner images) of the individual colors are respectively provided. Furthermore, an intermediate transfer belt 8 that is rotated in a counterclockwise direction in FIG. 1 is provided adjacent to the image formation portions Pa to Pd. The toner images formed on these photoconductive drums 1*a* to 1*d* are sequentially transferred onto the intermediate transfer belt 8 that is moved in contact with the photoconductive drums 1*a* to 1*d*, are thereafter transferred with a secondary transfer roller 9 onto a sheet P at one time and are further fixed on the sheet P in a fixing device 13 and the sheet P is then ejected from the image forming apparatus 100. While the photoconductive drums 1*a* to 1*d* are being rotated in a clockwise direction in FIG. 1, an image formation process is performed on the photoconductive drums 1*a* to 1*d*.

The sheet P to which the toner image is transferred is stored in a sheet cassette 16 arranged in a lower portion of the image forming apparatus 100, and is transported through a paper feed roller 12*a* and a registration roller pair 12*b* to the secondary transfer roller 9. As the intermediate transfer belt 8, a sheet of dielectric resin is used, and a seamless belt is mainly used. The intermediate transfer belt 8 and the secondary transfer roller 9 are driven to rotate by a belt drive motor (not shown) at the same linear speed as the photoconductive drums 1*a* to 1*d*. On the downstream side of the secondary transfer roller 9, a blade-shaped belt cleaner 19 for removing the toner and the like left on the surface of the intermediate transfer belt 8 is arranged.

The image formation portions Pa to Pd will now be described. Around and below the photoconductive drums 1*a* to 1*d*, which are rotatably arranged, are provided charging devices 2*a*, 2*b*, 2*c* and 2*d* that charge the photoconductive drums 1*a* to 1*d*, an exposure unit 5 that performs exposure based on image data to the photoconductive drums 1*a* to 1*d*, development devices 3*a*, 3*b*, 3*c* and 3*d* that develop, with toner, electrostatic latent images formed on the photoconductive drums 1*a* to 1*d* and cleaning devices 7*a*, 7*b*, 7*c* and 7*d* that collect and remove a developer (toner) left after the transfer of the toner images on the photoconductive drums 1*a* to 1*d*.

When the image data is input from a higher-level device such as a personal computer, the charging devices 2*a* to 2*d* first uniformly charge the surfaces of the photoconductive drums 1*a* to 1*d*, then the exposure unit 5 applies light based on the image data and electrostatic latent images corresponding to the image data are formed on the individual photoconductive drums 1*a* to 1*d*. The development devices 3*a* to 3*d* include development rollers (developer carrying members) arranged opposite the photoconductive drums 1*a* to 1*d*, and a predetermined amount of two-component developer containing the toner of each of the colors, that is, magenta, cyan, yellow and black is put into the development devices 3*a* to 3*d*, respectively.

When a proportion of the toner in the two-component developer with which the development devices 3*a* to 3*d* are filled becomes lower than a specified value by the formation of the toner image which will be described later, the developer is fed from containers 4*a* to 4*d* to the development devices 3*a* to 3*d*. The toner in the developer is supplied by the development devices 3*a* to 3*d* onto the photoconductive drums 1*a* to 1*d*, and is electrostatically adhered thereto, with the result that the toner image corresponding to the electrostatic latent image formed through the exposure by the exposure unit 5 is formed.

Then, a predetermined transfer voltage is applied by primary transfer rollers 6*a* to 6*d* between the primary transfer rollers 6*a* to 6*d* and the photoconductive drums 1*a* to 1*d*, and thus the toner images of magenta, cyan, yellow and black on the photoconductive drums 1*a* to 1*d* are primarily transferred onto the intermediate transfer belt 8. These images of the four colors are formed to have a predetermined positional relationship such that a predetermined full-color image is formed. The primary transfer rollers 6*a* to 6*d* are driven to rotate by a primary transfer drive motor (not shown) at the same linear speed as the photoconductive drums 1*a* to *d* and the intermediate transfer belt 8. Thereafter, in order for the subsequent formation of a new electrostatic latent image to be prepared, the toner left on the surfaces of the photoconductive drums 1*a* to 1*d* is removed by the cleaning devices 7*a* to 7*d*.

The intermediate transfer belt 8 is placed over a driven roller 10 and a drive roller 11; when the intermediate transfer belt 8 starts to be rotated in a counterclockwise direction as the drive roller 11 is rotated by the belt drive motor described above, the sheet P is transported from the registration roller pair 12*b* with predetermined timing to a nip portion (secondary transfer nip portion) between the secondary transfer roller 9 provided adjacent to the intermediate transfer belt 8 and the intermediate transfer belt 8, with the result that the full-color image is secondarily transferred onto the sheet P in the nip portion. The sheet P to which the toner image has been transferred is transported to the fixing device 13.

When the sheet P transported to the fixing device 13 passes through a nip portion (fixing nip portion) of a fixing roller pair 13*a*, the sheet P is heated and pressurized, and thus the toner image is fixed to the surface of the sheet P, with the result that the predetermined full-color image is formed. The sheet P on which the full-color image is formed is selectively transported, by a branch portion 14 branching into a plurality of directions, in a particular direction. When an image is formed on only one surface of the sheet P, the sheet P is ejected by an ejection roller pair 15 into an ejection tray 17 without being processed.

On the other hand, when images are formed on both surfaces of the sheet P, part of the sheet P passing through the fixing device 13 is temporarily protruded from the ejection roller pair 15 to the outside of the apparatus. Thereafter, the sheet P is selectively transported at the branch portion 14 by the reverse rotation of the ejection roller pair 15 to a reverse transport path 18, and with the surface of the image reversed, the sheet P is transported again to the secondary transfer roller 9. Then, the subsequent image formed on the intermediate transfer belt 8 is transferred by the secondary transfer roller 9 to the surface on which no image is formed on the sheet P and is transported to the fixing device 13 where the toner image is fixed and the sheet P is thereafter ejected into the ejection tray 17 by the ejection roller pair 15.

Figure 2:
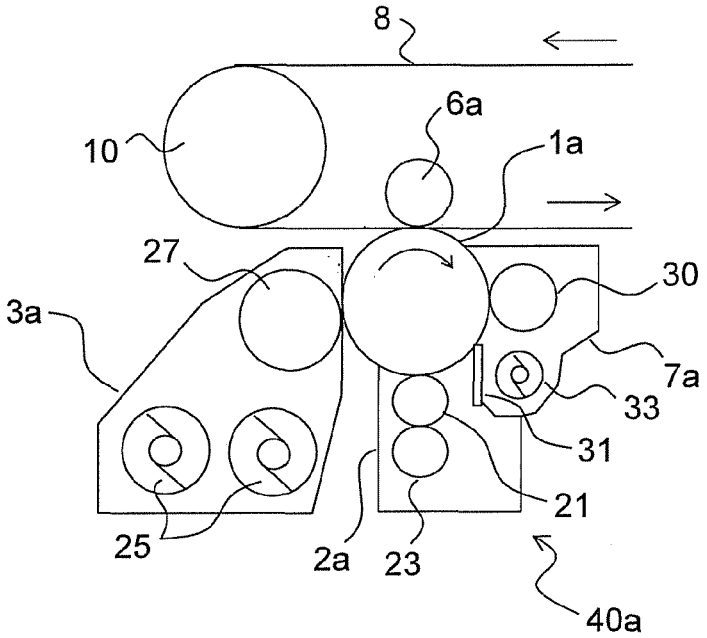
FIG. 2 is an enlarged cross-sectional view in the vicinity of an image formation portion Pa in FIG. 1.

The details of the image formation portion Pa described above will now be described. Since the image formation portions Pb to Pd have basically the same configuration as the image formation portion Pa, their detailed description will be omitted. FIG. 2 is an enlarged cross-sectional view in the vicinity of the image formation portion Pa in FIG. 1. Around the photoconductive drum 1*a*, along the direction of rotation of the drum (the clockwise direction of FIG. 2), the charging device 2*a*, the development device 3*a*, the primary transfer roller 6*a* and the cleaning device 7*a* are arranged. Among them, the primary transfer roller 6*a* is arranged in a position opposite the photoconductive drum 1*a* through the intermediate transfer belt 8.

The photoconductive drum 1*a*, the charging device 2*a* and the cleaning device 7*a* are formed into a unit. In the image formation portions Pa to Pd, units that are formed with the photoconductive drums 1*a* to 1*d*, the charging devices 2*a* to 2*d* and the cleaning devices 7*a* to 7*d* are referred to as drum units 40*a* to 40*d* in the following description.

The charging device 2*a* includes: a charging roller 21 that makes contact with the photoconductive drum 1*a* to apply a charging bias to the surface of the drum; and a charging cleaning roller 23 for cleaning the charging roller 21. The development device 3*a* includes: two agitation transport members consisting of an agitation transport screw 25*a* and a supply transport screw 25*b*; and a magnetic roller 27. The development device 3*a* makes the two-component developer (magnetic brash) carried on the surface of the magnetic roller 27 come into contact with the surface of the photoconductive drum 1*a*, and thereby develops the electrostatic latent image into the toner image.

The cleaning device 7*a* includes a scrubbing roller (polishing member) 30, a cleaning blade 31 and a collection spiral 33. The scrubbing roller 30 is pressed onto the photoconductive drum 1*a* at a predetermined pressure, and is driven to rotate, by a drum cleaning motor (not shown), in the same direction on the surface in contact with the photoconductive drum 1*a*, and its linear speed is controlled to be higher than (here, 1.2 times as high as) that of the photoconductive drum 1*a*. As the scrubbing roller 30, for example, there is a structure in which around a metal shaft, a foam layer made of EPDM rubber and having an Asker C hardness of 55° is formed as a roller member. The material of the roller member is not limited to EPDM rubber; a rubber of another material or a foam rubber member may be used, and a material having an Asker C hardness of 10 to 90° is preferably used.

The Asker C is one of the durometers (spring-type hardness testers) specified by the Society of Rubber Industry, Japan, and is a measuring device for measuring hardness. The Asker C hardness refers to the hardness that is measured with the above measuring device; as its value is higher, the material has a higher hardness.

On the downstream side in the rotation direction with respect to the surface of the photoconductive drum 1*a* in contact with the scrubbing roller 30, the cleaning blade 31 is fixed while being in contact with the photoconductive drum 1*a*. As the cleaning blade 31, for example, a blade made of polyurethane rubber and having a JIS hardness of 78° is used, and at the point in contact therewith, the cleaning blade 31 is attached at a predetermined angle with respect to the direction of the tangent of the photoconductive member. The material quality, the hardness, the dimensions, the amount of penetration into the photoconductive drum 1*a*, the pressing force and the like of the cleaning blade 31 are appropriately set according to the specifications of the photoconductive drum 1*a*. The JIS hardness refers to the hardness that is specified by JIS (Japanese Industrial Standards).

The residual toner that is removed from the surface of the photoconductive drum 1*a* by the scrubbing roller 30 and the cleaning blade 31 is discharged to the outside of the cleaning device 7*a* (see FIG. 2) as the collection spiral 33 is rotated. As the toner used in the present disclosure, a toner in which an abrasive selected from silica, titanium oxide, strontium titanate, alumina and the like is embedded in the surface of a loner particle and is retained such that its part protrudes from the surface or a toner in which an abrasive is electrostatistically adhered to the surface of the toner is used.

As described above, the scrubbing roller 30 is rotated with a difference in speed with respect to the photoconductive drum 1*a*, and thus the surface of the photoconductive drum 1*a* is polished by the residual toner containing the abrasive, with the result that water and a discharge product and the like on the surface of the drum are removed by the scrubbing roller 30 and the cleaning blade 31 together with the residual toner.

The layout of the interior of the main body of the image forming apparatus 100 can be changed as necessary as long as the rotation direction of the photoconductive drums 1*a* to 1*d* and the intermediate transfer belt 8 and the transport path of the sheet P can be set appropriately. For example, it is naturally possible to set the transport path as follows: the direction of rotation of the photoconductive drums 1*a* to 1*a* and the intermediate transfer belt 8 is reversed with respect to that in the present embodiment, the positional relationship between the drum units 40*a* to 40*d* and the development devices 3*a* to 3*d* is reversed with respect to that in the present embodiment and accordingly, the transport path of the sheet P is set.

Figure 3:
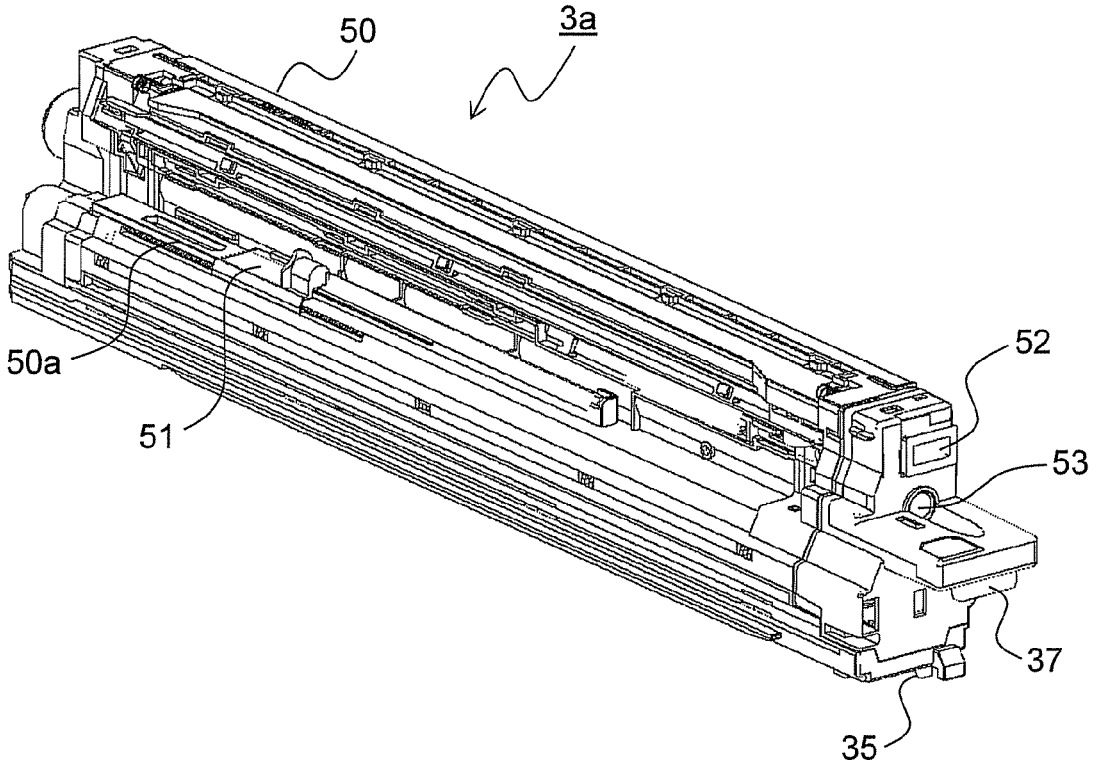
FIG. 3 is an external perspective view when a development device 3*a* incorporated in the image forming apparatus 100 is seen from the upstream side in a direction of insertion of the image forming apparatus 100.

FIG. 3 is an external perspective view when the development device 3*a* is seen from the upstream side in the direction of insertion of the image forming apparatus 100. Since the development devices 3*b* to 3*d* have basically the same configuration as the development device 3*a*, their detailed description will be omitted. The development device 3*a* includes, within a development container 50, the two agitation transport screws 25 and the magnetic roller 27 (see FIG. 2) described above. In the development container 50, a developer feed port 50*a* that is connected to a developer supply port 93 (see FIG. 15) of the container 4*a* (see FIG. 1) is formed, and a feed port shutter 51 that opens and closes the developer feed port 50*a* is provided. Through the developer feed port 50*a*, a developer containing the toner of the corresponding color (here, magenta) is supplied into the development device 3*a*, and is subjected to the development of the electrostatic latent image.

In the front surface of the development device 3*a*, a duct coupling portion 52 is formed that is coupled to a suction duct for sucking airborne toner within the development device 3*a*. Furthermore, below the duct coupling portion 52, a fitting hole 53 is formed into which the locating boss of a retainer 85 (see FIG. 7) arranged within an opening and closing cover is fitted. Furthermore, on the front surface of the development device 3*a*, an engagement hook 35 which engages with a unit support tray 103 (see FIG. 7) when the development device 3*a* is inserted into the image forming apparatus 100 and a lock cancellation lever 37 which cancels the engagement of the engagement hook 35 are provided. The engagement hook 35 and the lock cancellation lever 37 forming a lock mechanism can retain the development device 3*a* with the development device 3*a* fitted on the unit support tray 103 and can cancel the retainment.

Figure 4:
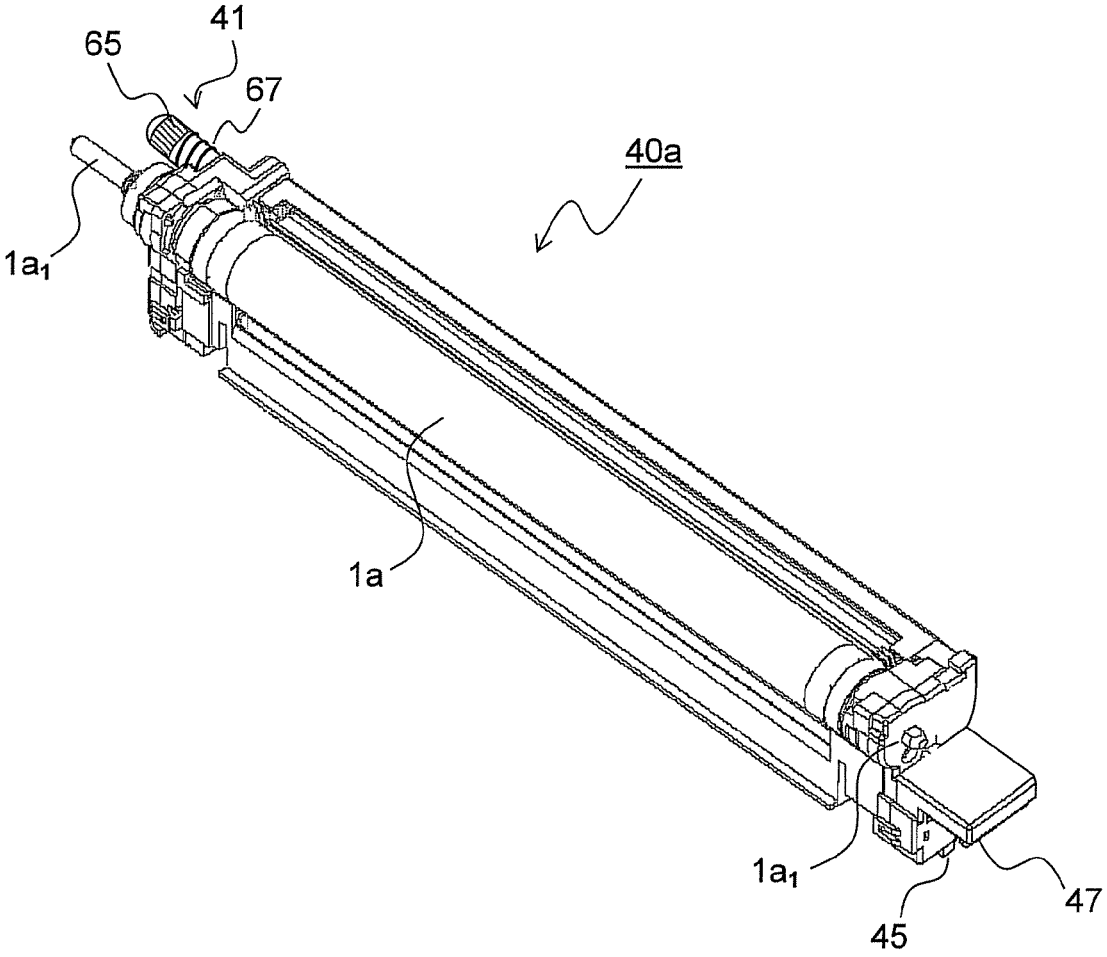
FIG. 4 is an external perspective view when a drum unit 40*a* arranged adjacent to the development device 3*a* is seen from the upstream side in the direction of insertion of the image forming apparatus 100.

FIG. 4 is an external perspective view when the drum unit 40*a* arranged adjacent to the development device 3*a* is seen from the upstream side in the direction of insertion of the image forming apparatus 100. Since the drum units 40*b* to 40*d* have basically the same configuration as the drum unit 40*a*, their detailed description will be omitted. From the front and back surfaces of the drum unit 40*a*, a drum shaft $\mathbf{1}a_1$ that is the rotation shaft of the photoconductive drum 1*a* protrudes. The drum shaft $\mathbf{1}a_1$ protruding from the front surface of the drum unit 40*a* is fitted into the shaft reception hole of the retainer 85 (see FIG. 7) arranged within the opening and closing cover (not shown) on the front surface side of the image forming apparatus 100. On the other hand, the drum shaft $\mathbf{1}a_1$ protruding from the back surface of the drum unit 40*a* is fitted into the shaft reception hole of a back surface-side frame 102 (see FIG. 7) of the image forming apparatus 100.

A toner discharge portion 41 is continuously provided so as to protrude from the back surface of the drum unit 40*a* in the direction of the shaft of the collection spiral 33 (see FIG. 2). The waste toner collected by the cleaning device 7*a* (see FIG. 2) is discharged from the toner discharge portion 41 by the rotation of the collection spiral 33, and is transported through a developer collection mechanism 90 (see FIG. 8) to a developer collection container (not shown). The toner discharge portion 41 includes: a first shutter member 65 that opens and closes a toner discharge port 69 (see FIG. 12); and a first coil spring 67 that is arranged between the first shutter member 65 and the housing of the drum unit 40*a*. Since the function and movement of the first shutter member 65 and the first coil spring 67 are the same as those of a second shutter member 80 and a second coil spring 81 of a developer discharge portion 50*e*, which will be described later, their description will be omitted.

Furthermore, on the front surface of the drum unit 40*a*, an engagement hook 45 which engages with the unit support tray 103 (see FIG. 7) when the drum unit 40*a* is inserted into the image forming apparatus 100 and a lock cancellation lever 47 which cancels the engagement of the engagement hook 45 are provided. The engagement hook 45 and the lock cancellation lever 47 form a lock mechanism that retains the drum unit 40*a* with the drum unit 40*a* fitted on the unit support tray 103.

Figure 5:
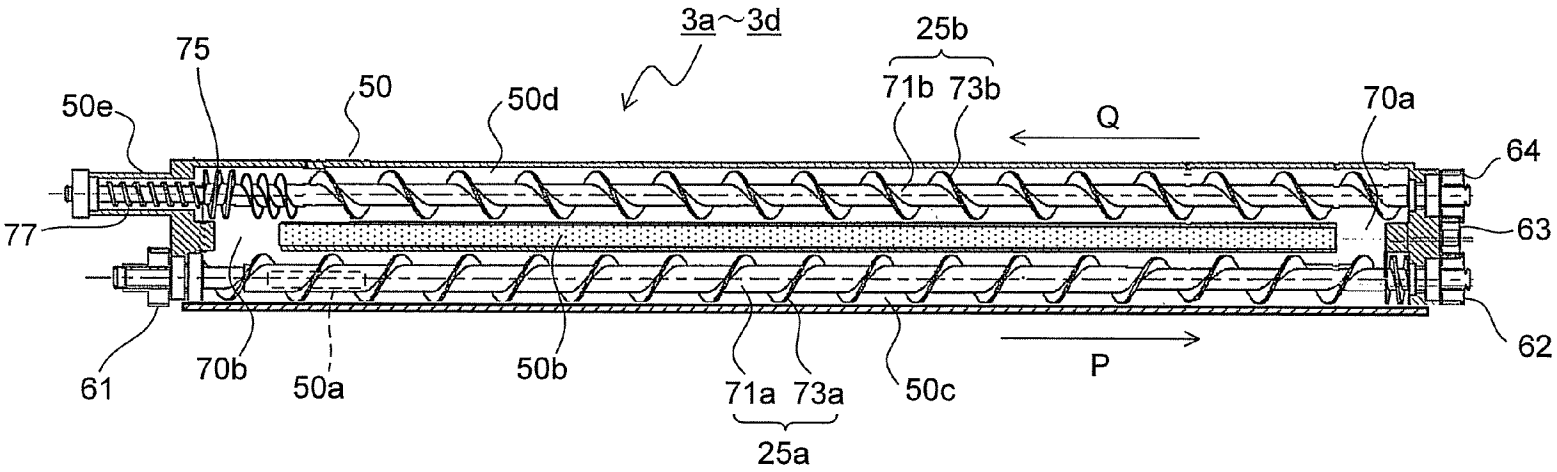
FIG. 5 is a planar cross-sectional view showing an agitation portion of development devices 3*a* to 3*d;*
Figure 6:
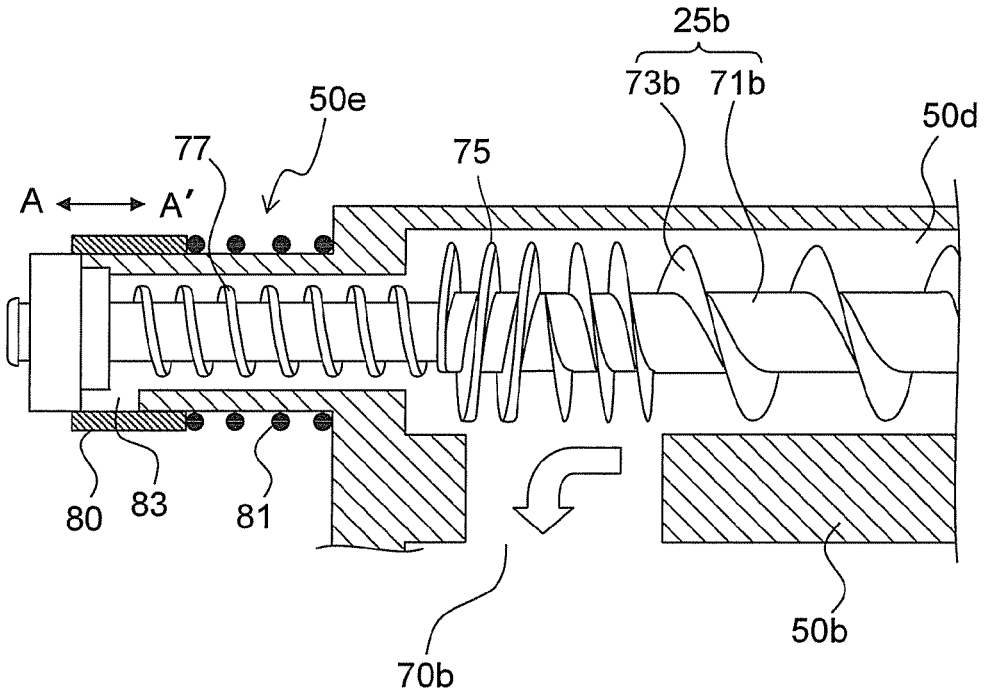
FIG. 6 is an enlarged view in the vicinity of a developer discharge portion 50*e* in FIG. 5.

The agitation portion of the development devices 3*a* to 3*d* will now be described in detail. FIG. 5 is a planar cross-sectional view showing the agitation portion of the development devices 3*a* to 3*d*, and FIG. 6 is an enlarged view in the vicinity of the developer discharge portion 50*e* in FIG. 5. Within the development container 50, by a partition wall 50*b*, an agitation transport chamber 50*c*, a supply transport chamber 50*d* and developer passages 70*a* and 70*b* are formed, and furthermore, the developer feed port 50*a* and the developer discharge portion 50*e* are formed. It is assumed that in the agitation transport chamber 50*c*, the left side of FIG. 5 is the upstream side, the right side of FIG. 5 is the downstream side, and that in the supply transport chamber 50*d*, the right side of FIG. 5 is the upstream side, and the left side of FIG. 5 is the downstream side. Hence, the developer passages 70*a* and 70*b* are referred to as the upstream side and the downstream side with respect to the supply transport chamber 50*d*.

The partition wall 50*b* extends in the longitudinal direction of the development container 50 and thereby partitions the agitation transport chamber 50*c* and the supply transport chamber 50*d* such that they are aligned parallel to each other. A right-side end portion in the longitudinal direction of the partition wall 50*b* forms the developer passage 70*a* on the upstream side together with the inner wall portion of the development container 50; on the other hand, a left-side end portion in the longitudinal direction of the partition wall 50*b* forms the developer passage 70*b* on the downstream side together with the inner wall portion of the development container 50. The developer can be circulated within the agitation transport chamber 50*c*, the developer passage 70*a*, the supply transport chamber 50*d* and the developer passage 70*b*.

The developer feed port 50*a* is an opening for feeding a new amount of developer from the containers 4*a* to 4*d* (see FIG. 1) provided above the development container 50 into the development container 50, and is arranged on the upstream side (the left side of FIG. 5) of the agitation transport chamber 50*c*.

The developer discharge portion 50*e* is an opening for discharging a surplus amount of developer within the agitation transport chamber 50*c* and the supply transport chamber 50*d* by the feed of the developer, and is continuously provided in the longitudinal direction of the supply transport chamber 50*d* on the downstream side of the supply transport chamber 50*d*.

Within the agitation transport chamber 50*c*, the agitation transport screw 25*a* is arranged; within the supply transport chamber 50*d*, the supply transport screw 25*b* is arranged. The agitation transport screw 25*a* includes: a rotation shaft 71*a*; and a spiral impeller 73*a* that is provided integrally with the rotation shaft 71*a* and that is formed spirally with a predetermined pitch in the direction of the rotation shaft 71*a*. The supply transport screw 25*b* includes: a rotation shaft 71*b*; and a spiral impeller 73*b* that is provided integrally with the rotation shaft 71*b* and that is formed spirally with a predetermined pitch in the direction of the rotation shaft 71*b*. The spiral impeller 73*b* of the supply transport screw 25*b* is an impeller that is faced in an opposite direction (that has an opposite phase) with the same pitch as the spiral impeller 73*a* of the agitation transport screw 25*a* and that is formed spirally. The rotation shafts 71*a* and 71*b* of the agitation transport screw 25*a* and the supply transport screw 25*b* are pivoted on the wall portions of the development container 50 on both end sides in the longitudinal direction.

On the rotation shaft 71*b* of the supply transport screw 25*b*, a restriction portion 75 and a discharge impeller 77 are integrally formed together with the spiral impeller 73*b*.

The restriction portion 75 is used for blocking the developer transported to the downstream side within the supply transport chamber 50*d* and for transporting a predetermined amount or more of developer to the developer discharge portion 50*e*. The restriction portion 75 is an impeller that is faced in an opposite direction (that has an opposite phase) to a spiral impeller 73*b* and that is formed spirally, and is set substantially equal to the outside diameter of the spiral impeller 73*b* and less than the pitch of the spiral impeller 73*b*. Between the inner wall portion of the development container 50 and the outer circumferential edge of the restriction portion 75, a predetermined amount of space is formed. Through this space, a surplus amount of developer is discharged into the developer discharge portion 50*e*.

The rotation shaft 71*b* extends into the developer discharge portion 50*e*. The rotation shaft 71*b* within the developer discharge portion 50*e* is provided with the discharge impeller 77. Although the discharge impeller 77 is a spiral impeller that is faced in the same direction as the spiral impeller 73*b*, its pitch is less than that of the spiral impeller 73*b*, and the outside diameter of the impeller is less than that of the spiral impeller 73*b*. Hence, as the rotation shaft 71*b* is rotated, the discharge impeller 77 is also rotated, and thus a surplus amount of developer that is extended over the restriction portion 75 and that is transported into the developer discharge portion 50*e* is sent to the left side of FIG. 5, and is discharged to the outside of the development container 50. The discharge impeller 77, the restriction portion 75 and the spiral impeller 73*b* are molded of synthetic resin integrally with the rotation shaft 71*b*.

On the external wall of the development container 50, gear wheels 61 to 64 are arranged. The gear wheels 61 and 62 are fixed and adhered to the rotation shaft 71*a*, the gear wheel 64 is fixed and adhered to the rotation shaft 71*b* and the gear wheel 63 is rotatably retained to the development container 50 and is meshed with the gear wheels 62 and 64.

As the gear wheel 61 is rotated by a drive source such as a motor at the time of development when a new amount of developer is not fed, the agitation transport screw 25*a* is rotated, with the result that the developer within the agitation transport chamber 50*c* is transported in a direction of an arrow P and is transported, through the developer passage 70*a*, into the supply transport chamber 50*d*. Furthermore, the drive force of the agitation transport screw 25*a* is transmitted through the gear wheels 62 to 64 to the supply transport screw 25*b*, and thus the supply transport screw 25*b* is rotated, with the result that the developer within the supply transport chamber 50*d* is transported in a direction of an arrow Q. Hence, the developer is transported from the agitation transport chamber 50*c* through the developer passage 70*a* on the upstream side into the supply transport chamber 50*d* while its volume is being greatly changed, and is transported, without being extended over the restriction portion 75, through the developer passage 70*b* on the downstream side, to the agitation transport chamber 50*c*.

As described above, the developer is agitated while being circulated from the agitation transport chamber 50*c* to the developer passage 70*a*, to the supply transport chamber 50*d* and to the developer passage 70*b*, and the agitated developer is supplied to the magnetic roller 27 (see FIG. 2).

A case where a new amount of developer is fed from the developer feed port 50*a* will now be described. When the toner is consumed by the development, the developer containing a carrier is fed through the developer feed port 50*a* into the agitation transport chamber 50*c*.

As in the development, the fed developer is transported by the agitation transport screw 25*a* within the agitation transport chamber 50*c* in the direction of the arrow P, and is thereafter transported, through the developer passage 70*a* on the upstream side, into the supply transport chamber 50*d*. Furthermore, the developer within the supply transport chamber 50*d* is transported by the supply transport screw 25*b* in the direction of the arrow Q. As the supply transport screw 25*b* is rotated, the restriction portion 75 is rotated, and thus a transport force is applied by the restriction portion 75 to the developer in a direction opposite to the direction of transport of the developer of the spiral impeller 73*b* (in the direction of the arrow Q). The developer is blocked by the restriction portion 75, and thus its volume is increased, with the result that a surplus amount of developer is extended over the restriction portion 75 and is discharged through the developer discharge portion 50*e* to the outside of the development container 50.

As shown in FIG. 6, on the outer circumferential surface of the developer discharge portion 50*e*, the second shutter member 80 is fitted. The second shutter member 80 is a cylindrical member which is inserted externally such that it can slide with respect to the developer discharge portion 50*e* in the direction of the shaft (the direction of arrows A and A'). Between the second shutter member 80 and the development container 50, the second coil spring 81 is arranged. The second shutter member 80 receives a force acting in the direction of the arrow A applied by the second coil spring 81; with the development devices 3*a* to 3*d* removed from the main body of the image forming apparatus 100, as shown in FIG. 6, the second shutter member 65 is arranged in such a position as to overlap a developer discharge port 83, and thus the developer discharge port 83 is blocked.

Figure 7:
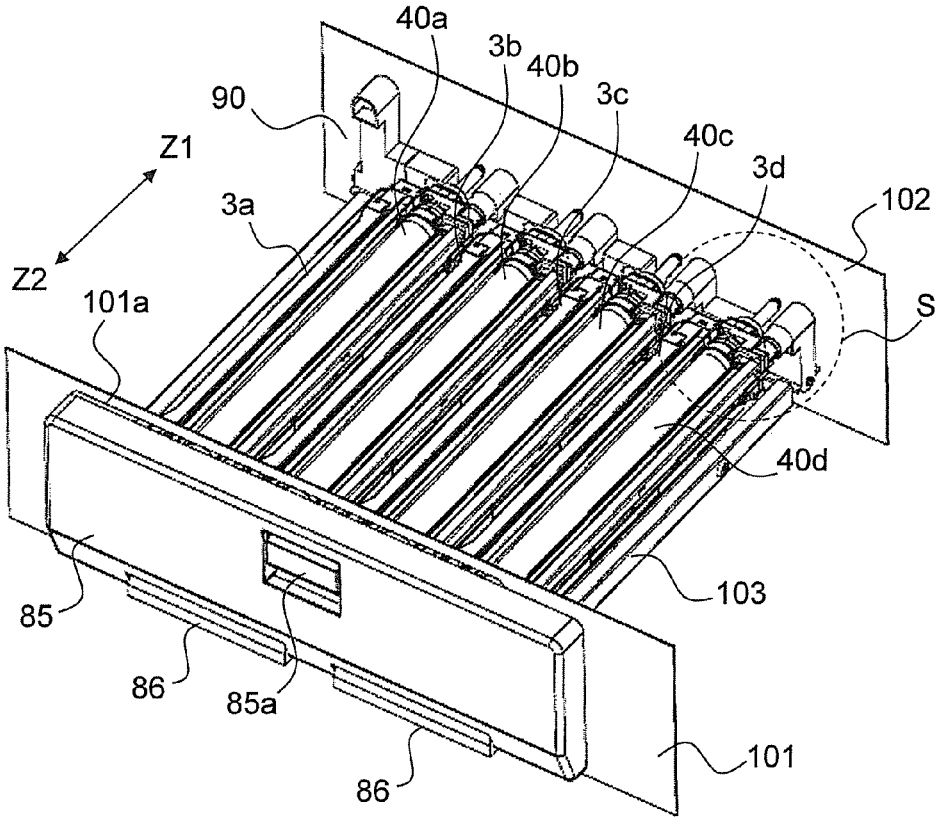
FIG. 7 is a perspective view showing a state where the development devices 3*a* to 3*d* and the drum units 40*a* to 40*d* are fitted into the image forming apparatus 100.
Figure 8:
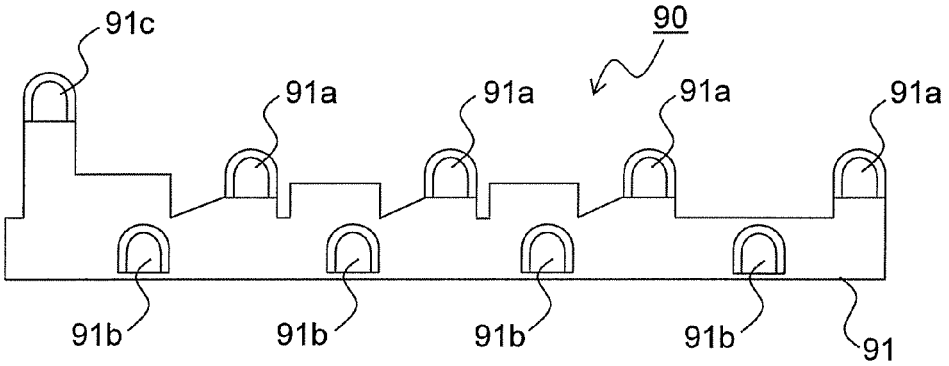
FIG. 8 is a front view of a developer collection mechanism 90 to which the development devices 3*a* to 3*d* and the drum units 40*a* to 40*d* are coupled.
Figure 9:
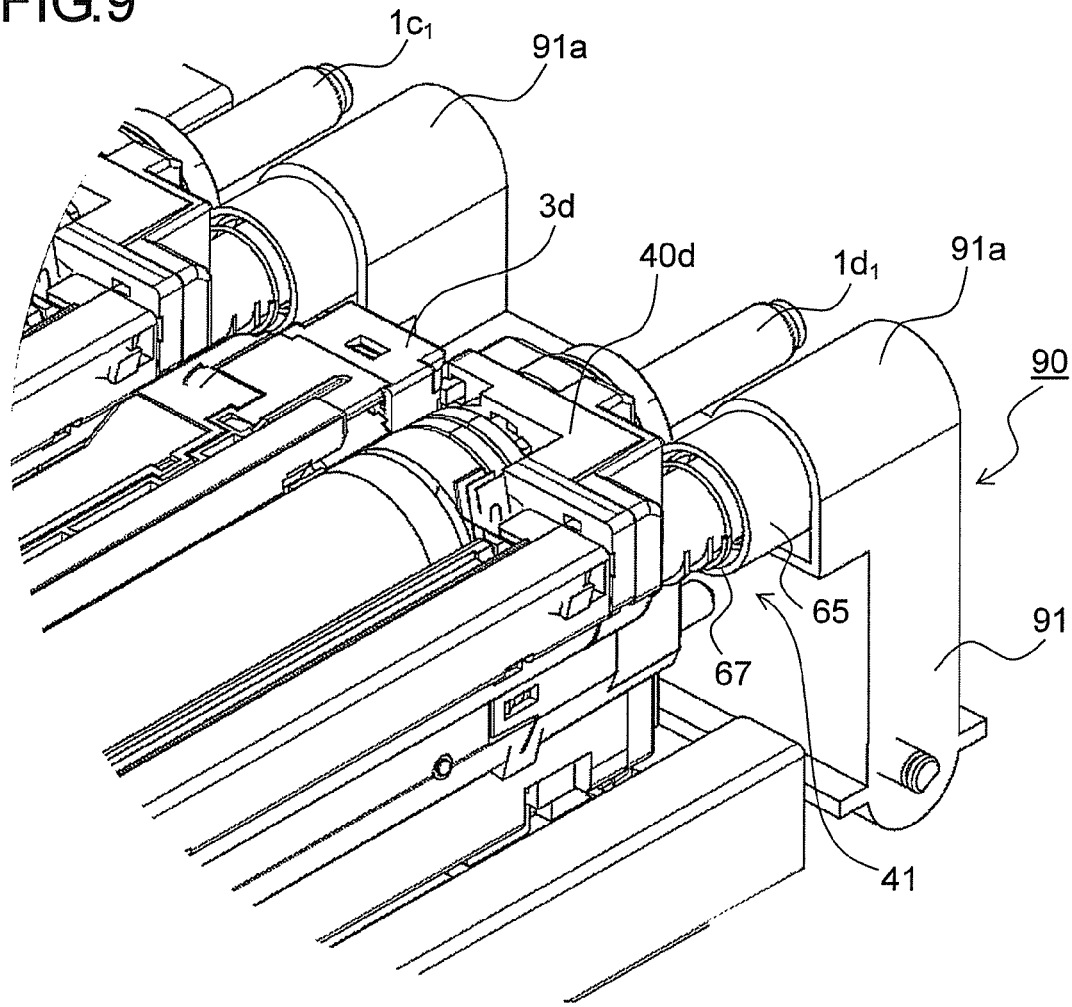
FIG. 9 is a perspective view showing a state where a toner discharge portion 41 of the drum unit 40*d* and a first coupling portion 91*a* of the developer collection mechanism 90 are coupled.
Figure 10:
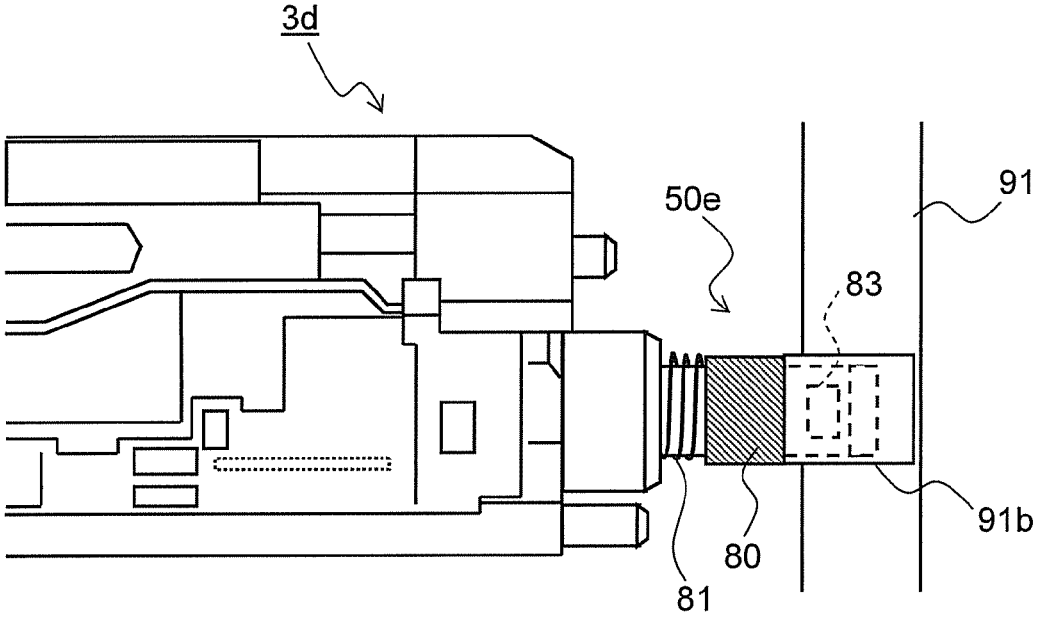
FIG. 10 is a plan view when a state where a developer discharge portion 50*e* of the development device 3*d* and a second coupling portion 91*b* of the developer collection mechanism 90 are coupled is seen from above.

FIG. 7 is a perspective view showing a state where the development devices 3*a* to 3*d* and the drum units 40*a* to 40*d* are fitted into the image forming apparatus 100; FIG. 8 is a front view of the developer collection mechanism 90 to which the development devices 3*a* to 3*d* and the drum units 40*a* to 40*d* are coupled; FIG. 9 is an enlarged perspective view of a portion where the toner discharge portion 41 of the drum unit 40*d* and the developer collection mechanism 90 are coupled; FIG. 10 is a plan view when a portion where the developer discharge portion 50*e* of the development device 3*d* and the developer collection mechanism 90 are coupled is seen from above. Although in FIGS. 9 and 10, only the drum unit 40*d* and the development device 3*d* are shown in the figures, since the drum units 40*a* to 40*c* and the development devices 3*a* to 3*c* are completely the same, their description will be omitted.

The retainer 85 is supported to a front surface-side frame 101 such that the retainer 85 can be pivoted, in an up/down direction, about a hinge portion 86 provided on a lower end portion, and the retainer 85 opens and closes an opening portion 101*a* formed in the front surface-side frame 101. In the retainer 85, a locating plate (not shown) is retained that locates one ends of the drum shafts $\mathbf{1}a_1$, $\mathbf{1}b_1$, $\mathbf{1}c_1$ and $\mathbf{1}d_1$. The retainer 85 is pivoted about the hinge portion 86, and thus the drum shafts $\mathbf{1}a_1$, $\mathbf{1}b_1$, $\mathbf{1}c_1$ and $\mathbf{1}d_1$ are relatively inserted and removed into and from the shaft reception holes of the locating plate. In the center portion of the retainer 85, a handle 85*a* is provided; the handle 85*a* is grasped to cancel a lock mechanism (not shown) between the retainer 85 and the front surface-side frame 101.

The developer collection mechanism 90 includes a transport path 91 within which a transport screw (not shown) is arranged and a developer collection container (not shown) in which the developer transported through the transport path 91 is stored. In the transport path 91, there are formed: four first coupling portions 91*a* to which the toner discharge portions 41 (see FIG. 4) of the drum units 40*a* to 40*d* are coupled; four second coupling portions 91*b* to which the developer discharge portions 50*e* (see FIG. 5) of the development devices 3*a* to 3*d* are coupled; and a third coupling portion 91*c* which is coupled to the developer collection container. The developer collection mechanism 90 is supported to a back surface-side frame 102 that is arranged on the side opposite to the front surface-side frame 101 through the development devices 3*a* to 3*d* and the drum units 40*a* to 40*d*.

The development devices 3*a* to 3*d* and the drum units 40*a* to 40*d* are removably supported to the unit support tray 103. The unit support tray 103 is supplied by a guide rail (not shown) provided in the frame of the image forming apparatus 100 such that the unit support tray 103 can reciprocate in a front/back direction (the direction of arrows Z1 and Z2). In the following description, the direction (the direction of the arrow Z1) in which the development devices 3*a* to 3*d* and the drum units 40*a* to 40*d* are fitted into the main body of the image forming apparatus 100 is referred to as a first direction, and the direction (the direction of the arrow Z2) in which the development devices 3*a* to 3*d* and the drum units 40*a* to 40*d* are removed from the main body of the image forming apparatus 100 is referred to as a second direction.

In the state of FIG. 7 where the development devices 3*a* to 3*d* and the drum units 40*a* to 40*d* are fitted into the image forming apparatus 100, as shown in FIG. 9, the toner discharge portions 41 of the drum units 40*a* to 40*d* are coupled to the first coupling portions 91*a* of the developer collection mechanism 90. Here, the first shutter member 65 is pressed onto the first coupling portion 91*a*, and thus the first coil spring 67 is moved in a direction in which it is compressed, with the result that the toner discharge port 69 (see FIG. 12) is opened within the first coupling portion 91*a*.

As shown in FIG. 10, the developer discharge portion 50*e* of the development devices 3*a* to 3*d* is coupled to the second coupling portion 91*b* of the developer collection mechanism 90. Here, the second shutter member 80 is pressed onto the second coupling portion 91*b*, and thus the second coil spring 81 is moved in a direction in which it is compressed, with the result that the discharge port 83 is opened within the second coupling portion 91*b*.

Figure 11:
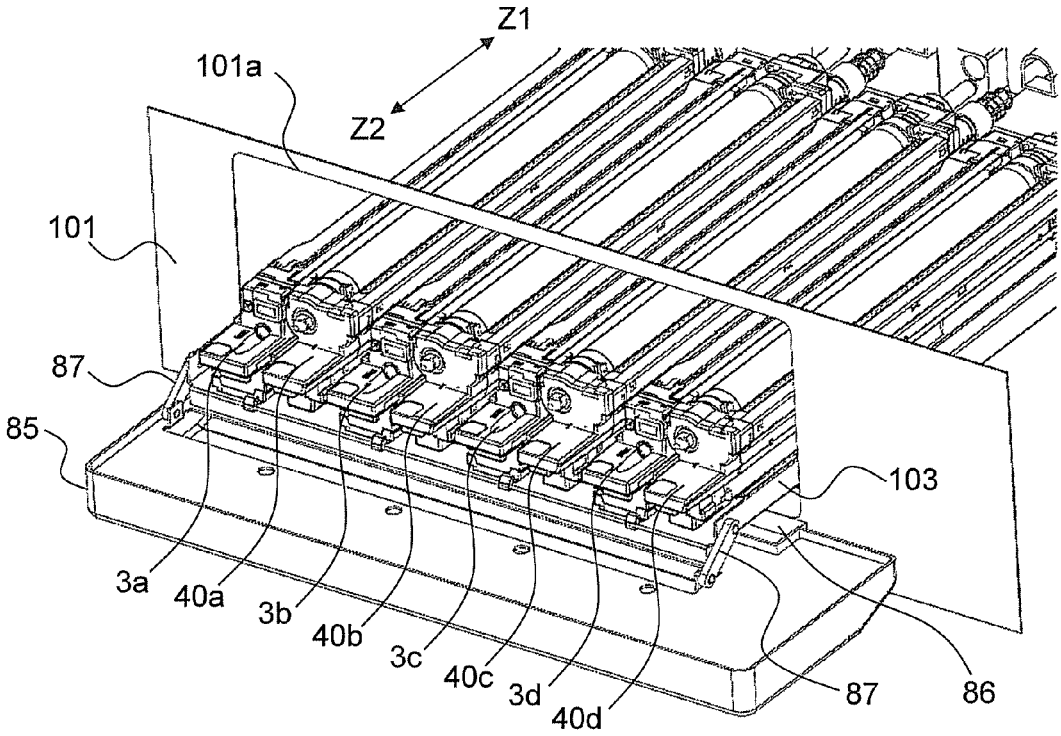
FIG. 11 is a perspective view showing a state where the development devices 3*a* to 3*d* and the drum units 40*a* to 40*d* are remove from the image forming apparatus 100 together with a unit support tray 103.

The insertion and removal operations of the development devices 3*a* to 3*d* and the drum units 40*a* to 40*d* into and from the image forming apparatus 100 will now be described. The handle 85*a* is grasped, the retainer 85 is rotated from the state of FIG. 7 in a downward direction and thus as shown in FIG. 11, the opening portion 101*a* of the front surface-side frame 101 is opened, with the result that the development devices 3*a* to 3*d* and the drum units 40*a* to 40*d* become accessible.

The back surface of the retainer 85 and the end portions of the unit support tray 103 in a direction (second direction) in which the unit support tray 103 is removed are coupled with link members 87. Thus, as the retainer 85 is rotated in the downward direction, the unit support tray 103 is removed forward by about 40 to 50 mm, and the development devices 3*a* to 3*d* and the drum units 40*a* to 40*d* are moved horizontally in the second direction (the direction of an arrow Z2) together with the unit support tray 103. Consequently, one ends of the development devices 3*a* to 3*d* and the drum units 40*a* to 40*d* protrude from the opening portion 101*a* of the front surface-side frame 101.

Figure 12:
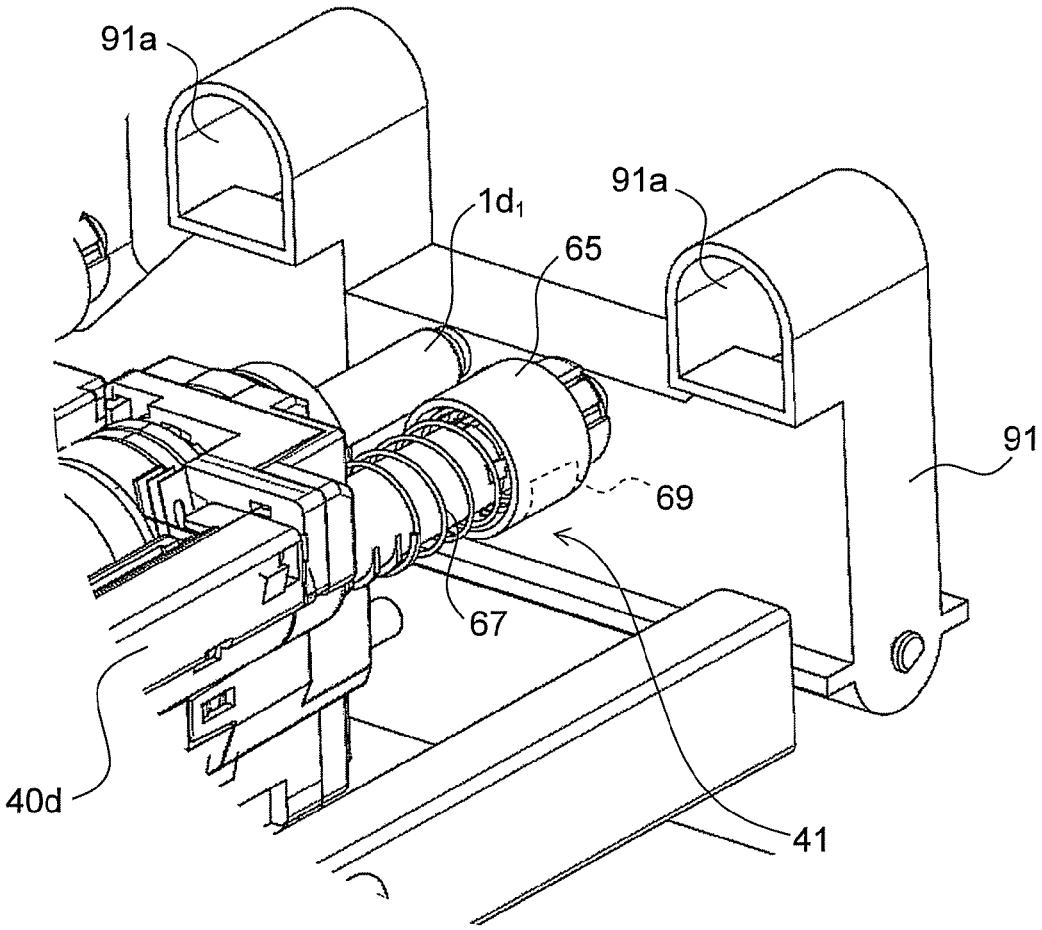
FIG. 12 is a perspective view showing a state where the coupling between the toner discharge portion 41 of the drum unit 40*d* and the first coupling portion 91*a* of the developer collection mechanism 90 is cancelled.

The drum units 40*a* to 40*d* are moved horizontally in the second direction, and thus as shown in FIG. 12, the coupling between the toner discharge portion 41 of the drum units 40*a* to 40*d* and the first coupling portion 91*a* of the developer collection mechanism 90 is cancelled, with the result that the pressing force from the first coupling portion 91*a* is prevented from acting on the first shutter member 65. Consequently, the first shutter member 65 is moved in a direction in which the toner discharge port 69 is closed by the force applied by the first coil spring 67 at the same time when the coupling between the toner discharge portion 41 and the first coupling portion 91*a* is cancelled.

Figure 13:
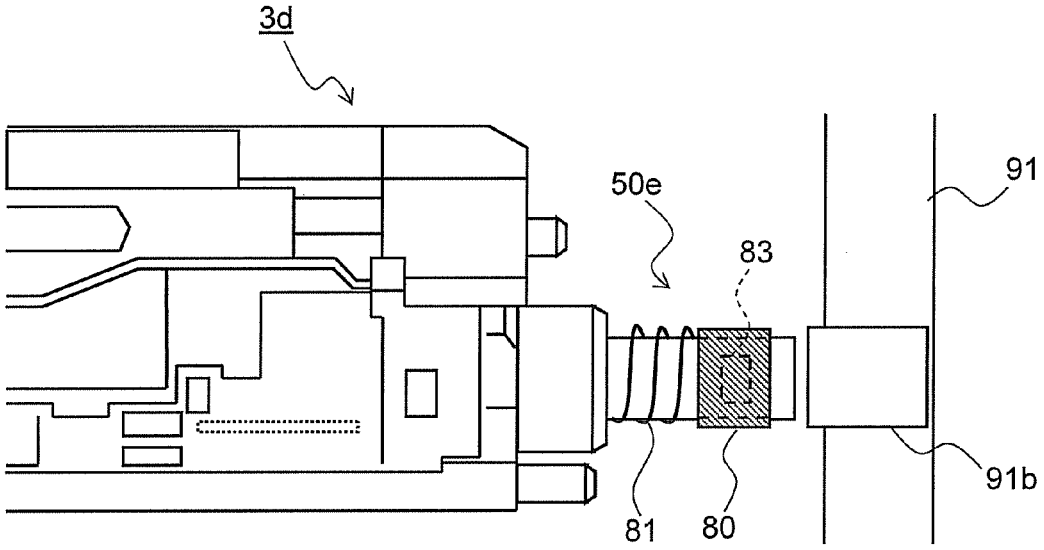
FIG. 13 is a plan view when a state where the coupling between the developer discharge portion 50*e* of the development device 3*d* and the second coupling portion 91*b* of the developer collection mechanism 90 is cancelled is seen from above.

The development devices 3*a* to 3*d* are moved horizontally in the second direction, and thus as shown in FIG. 13, the coupling between the developer discharge portion 50*e* of the development devices 3*a* to 3*d* and the second coupling portion 91*b* of the developer collection mechanism 90 is cancelled, with the result that the pressing force from the second coupling portion 91*b* is prevented from acting on the second shutter member 80.

Consequently, the second shutter member 80 is moved in a direction in which the developer discharge port 83 is closed by the force applied by the second coil spring 81 at the same time when the coupling between the developer discharge portion 50*e* and the second coupling portion 91*b* is cancelled.

Figure 14:
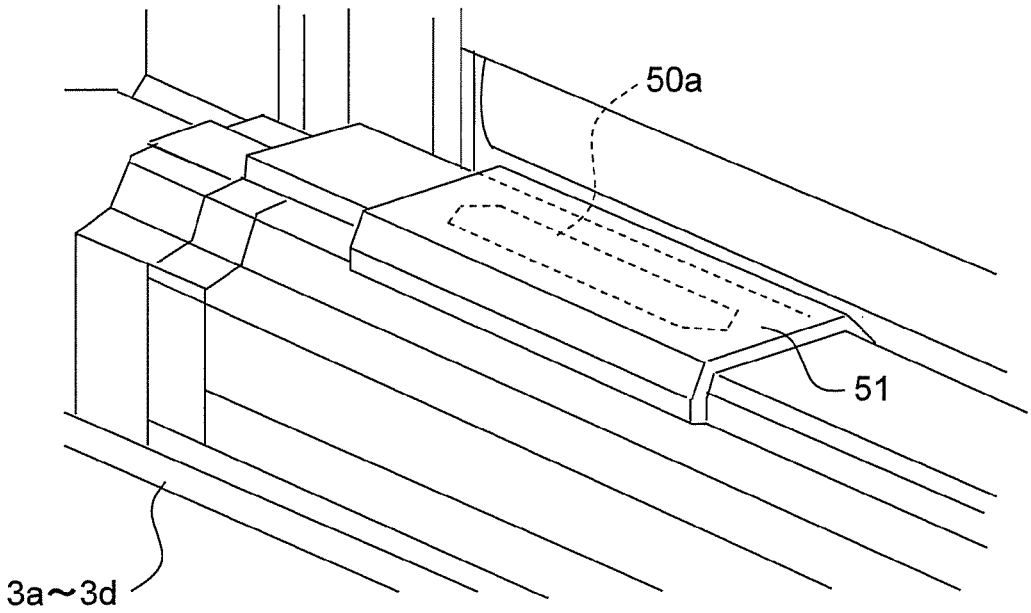
FIG. 14 is a partial perspective view showing a state where a developer feed port 50*a* of the development devices 3*a* to 3*d* is closed by a feed port shutter 51.

Furthermore, the coupling between the development devices 3*a* to 3*d* and the containers 4*a* to 4*d* is also cancelled, and as shown in FIG. 14, the developer feed port 50*a* of the development devices 3*a* to 3*d* is closed by the feed port shutter 51.

Figure 15A:
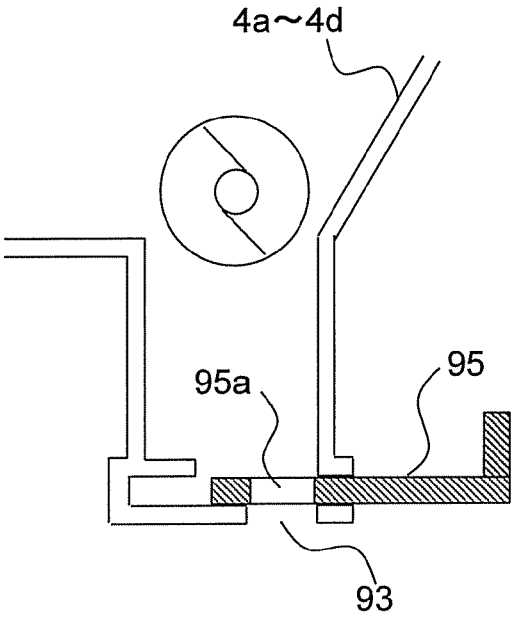
FIG. 15A is a partial perspective view showing a state where a developer supply port 93 of containers 4*a* to 4*d* is opened by a supply port shutter 95.
Figure 15B:
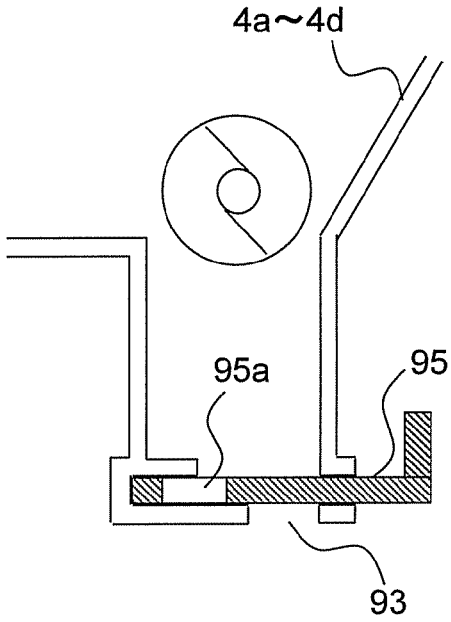
FIG. 15B is a partial perspective view showing a state where the developer supply port 93 of the containers 4*a* to 4*d* is closed by the supply port shutter 95.

On the other hand, as shown in FIG. 15A, in a state where the development devices 3*a* to 3*d* and the containers 4*a* to 4*d* are coupled, the developer supply port 93 of the containers 4*a* to 4*d* overlaps the opening 95*a* of a supply port shutter 95 so as to be opened. When from this state, the development devices 3*a* to 3*d* are moved horizontally in the second direction, as shown in FIG. 15B, the supply port shutter 95 is moved in such a position the opening 95*a* does not overlap the developer supply port 93, with the result that the developer supply port 93 is closed.

Figure 16:
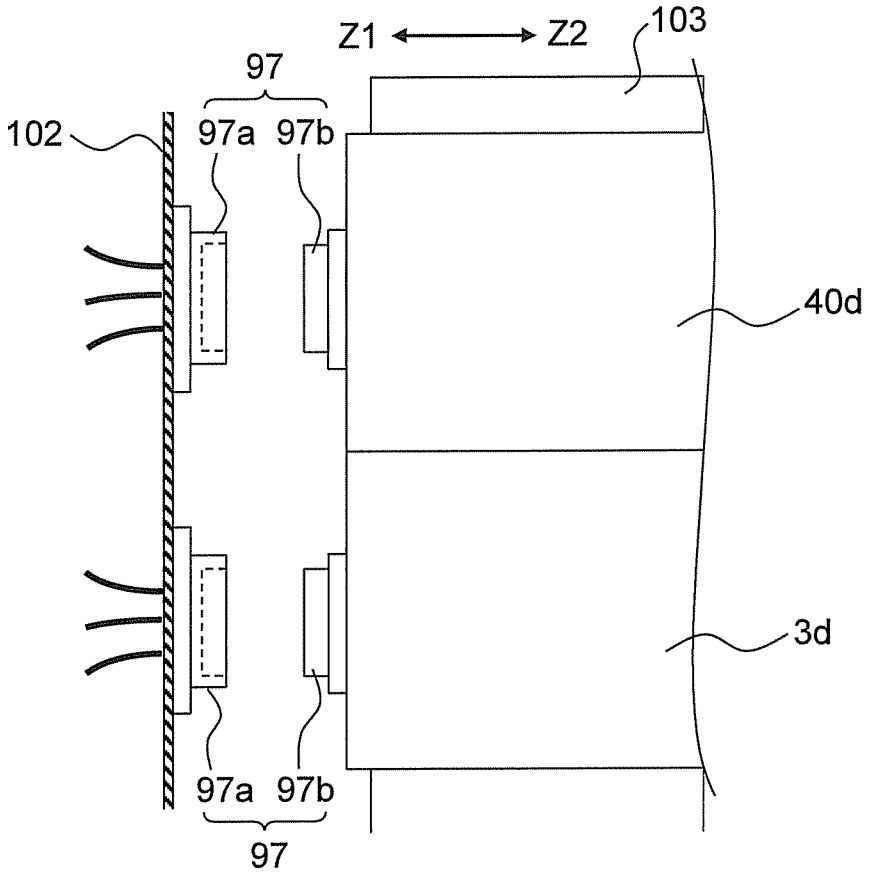
FIG. 16 is a diagram when a state where the coupling of a drawer connector 97 formed with a main body-side connector 97*a* and a unit-side connector 97*b* is cancelled is seen from above.

As shown in FIG. 16, unit-side connectors 97*b* that are coupled to main body-side connectors 97*a* provided on the back surface-side frame 102 are attached to the end portions of the development devices 3*a* to 3*d* and the containers 4*a* to 4*d* on the downstream side (the left side of FIG. 16) in the first direction (the direction of the arrow Z1). The main body-side connectors 97*a* and the unit-side connectors 97*b* form drawer connectors 97 that electrically connect the development devices 3*a* to 3*d* and the drum units 40*a* to 40*d* to the main body of the image forming apparatus 100. The drum units 40*a* to 40*d* and the development devices 3*a* to 3*d* are moved horizontally in the second direction, and thus the coupling of the drawer connectors 97 is also cancelled.

Figure 17:
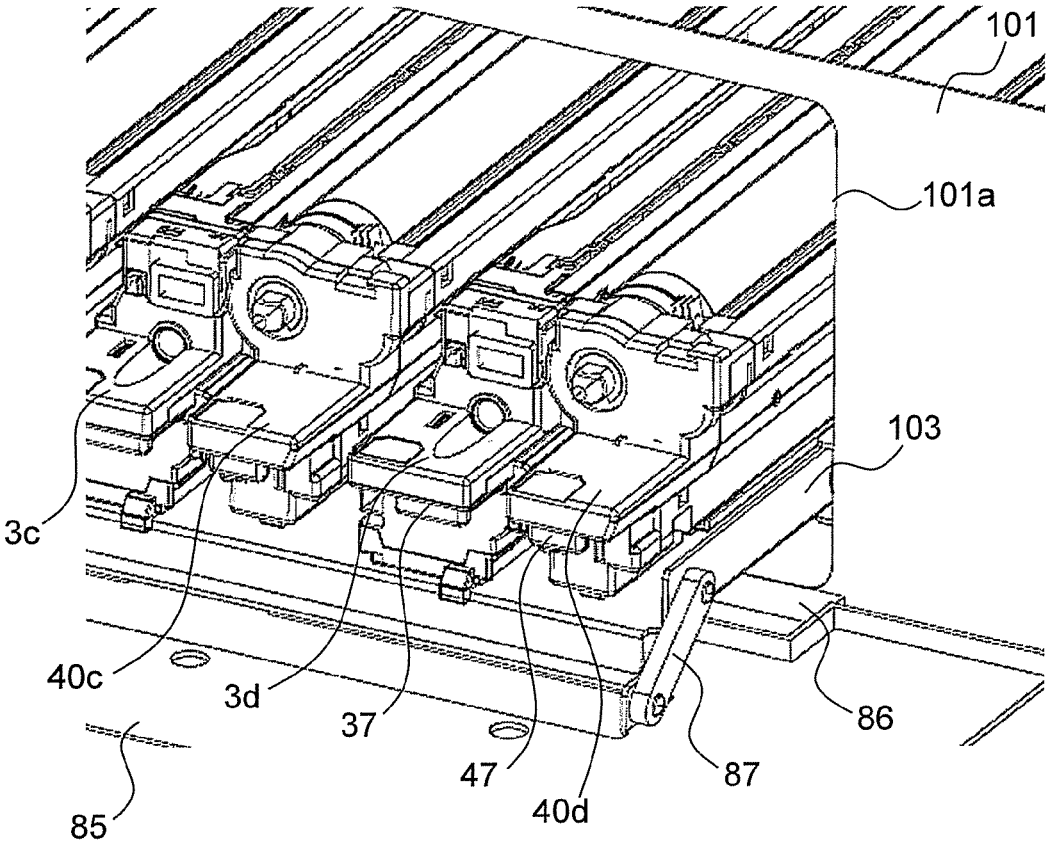
FIG. 17 is a partially enlarged view in the vicinity of the development device 3*d* and the drum unit 40*d* in FIG. 11.
Figure 18:
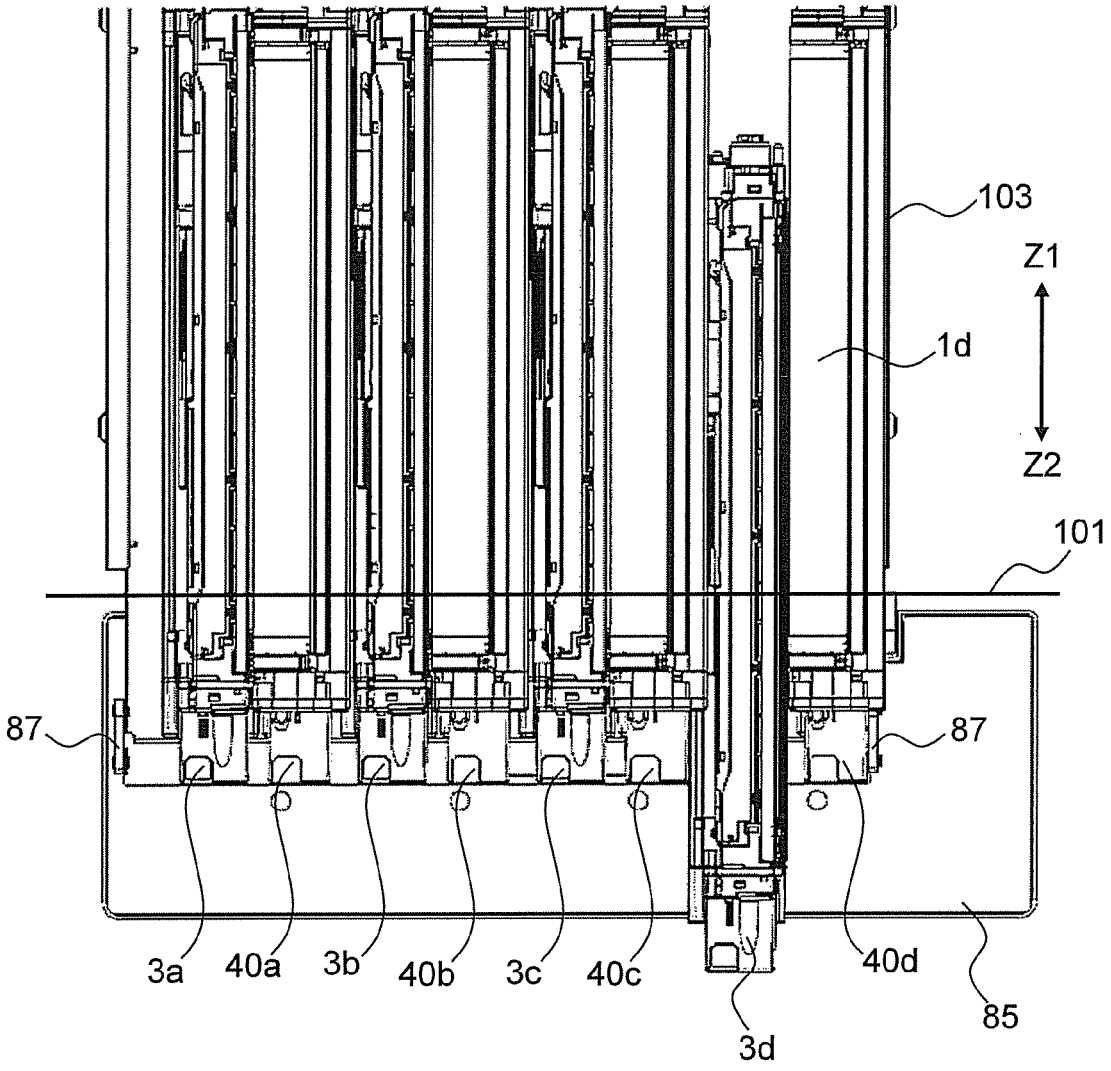
FIG. 18 is a plan view when how the development device 3*d* is removed is seen from above.

FIG. 17 is a partially enlarged view in the vicinity of the development device 3*d* and the drum unit 40*d* in FIG. 11; FIG. 18 is a plan view when how the development device 3*d* is removed is seen from above. When the development device 3*d* is removed from the image forming apparatus 100, the lock cancellation lever 37 is pushed up to cancel the engagement between the engagement hook 35 (see FIG. 3) provided in a lower portion on the front side of the development device 3*a* and the unit support tray 103, and as shown in FIG. 18, the development device 3*d* is removed in the second direction (the direction of the arrow Z2).

Figure 19:
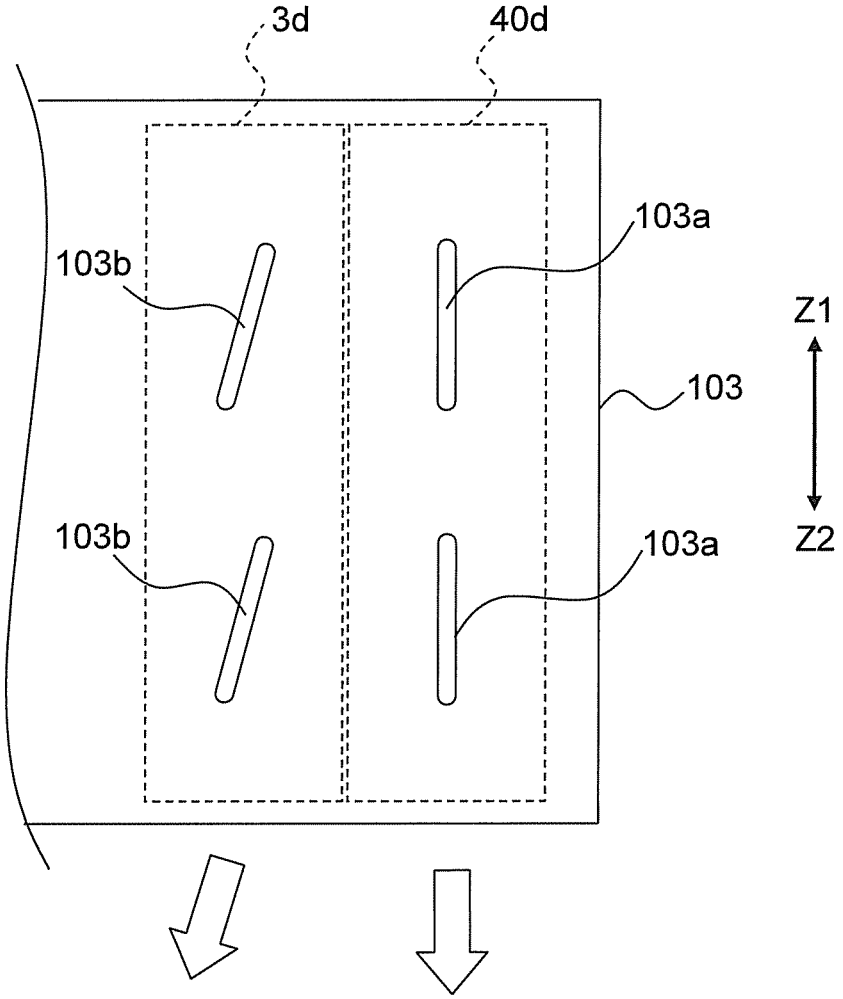
FIG. 19 is a plan view showing a first rib 103*a* serving a guide member when the drum unit 40*d* is inserted or removed and a second rib 103*b* serving as a guide member when the development device 3*d* is inserted or removed that are formed on a unit support tray 103.

Here, as shown in FIG. 19, on the unit support tray 103, a first rib 103*a* that is a guide member when the drum unit 40*d* is inserted and removed and a second rib 103*b* that is a guide member when the development device 3*d* is inserted and removed are formed. The first rib 103*a* is formed parallel to the second direction (the direction of the arrow Z2) whereas the second rib 103*b* is formed obliquely so as to extend away from the first rib 103*a* in the second direction.

In other words, since the development device 3*d* is removed along the second rib 103*b*, and thus the magnetic roller 27 (see FIG. 2) is moved in a direction in which the magnetic roller 27 is retracted from the photoconductive drum 1*d*, the magnetic roller 27 is prevented from making contact with the photoconductive drum 1*d* by the operation of removing the development device 3*d*, with the result that the surfaces of the photoconductive drum 1*d* and the magnetic roller 27 are prevented from being scratched.

When the drum unit 40*d* is removed, after the removal of the development device 3*d*, the lock cancellation lever 47 is pushed up to cancel the engagement between the engagement hook 45 (see FIG. 4) provided in a lower portion on the front side of the drum unit 40*d* and the unit support tray 103, and the drum unit 40*d* is removed along the first rib 103*a* in the second direction (the direction of the arrow Z2).

On the other hand, when the development device 3*d* and the drum unit 40*d* are fitted into the image forming apparatus 100, the drum unit 40*d* is first inserted along the first rib 103*a* in the first direction (the direction of the arrow Z1). Then, when the drum unit 40*d* is completely inserted, the engagement hook 45 engages with the unit support tray 103 to keep the drum unit 40*d* fitted.

Then, when the development device 3*d* is inserted along the second rib 103*b* in the first direction (the direction of the arrow Z1), the magnetic roller 27 gradually approaches the photoconductive drum 1*d* of the drum unit 40*d*. Then, when the development device 3*d* is completely inserted, the magnetic roller 27 approaches the photoconductive drum 1*d* such that a predetermined distance is left therebetween, and thus it is possible to develop the electrostatic latent image on the photoconductive drum 1*d*. The engagement hook 35 engages with the unit support tray 103, and thus the development device 3*d* is kept fitted. In this way, the state returns to the state of FIG. 11.

The insertion and removal operations of the development device 3*d* and the drum unit 40*d* have been described above, and the development devices 3*a* to 3*c* and the drum units 40*a* to 40*c* can be described exactly in the same manner. Here, since only the second rib 103*b* serving as the guide member of the development devices 3*a* to 3*d* is inclined, it is necessary to first remove the development devices 3*a* to 3*d* and first insert the drum units 40*a* to 40*c*. Hence, the first rib 103*a* serving as the guide member of the drum units 40*a* to 40*c* is inclined in a direction opposite to the second rib 103*b*, and thus no matter in what order the development devices 3*a* to 3*d* and the drum units 40*a* to 40*d* are inserted and removed, the magnetic roller 27 can be prevented from making contact with the photoconductive drum 1*a*.

Then, as the retainer 85 is rotated, from the state of FIG. 11, in an upward direction so as to be closed, the development devices 3*a* to 3*d* and the drum units 40*a* to 40*d* are moved horizontally in the first direction (the direction of the arrow Z1) together with the unit support tray 103. Thus, as shown in FIGS. 9 and 10, the toner discharge portion 41 of the drum units 40*a* to 40*d*, the developer discharge portion 50*e* of the development devices 3*a* to 3*d* and the first coupling portion 91*a* and the second coupling portions 91*b* of the developer collection mechanism 90 are coupled. The developer feed port 50*a* of the development devices 3*a* to 3*d* and the developer supply port 93 of the containers 4*a* to 4*d* and the drawer connector 97 electrically connecting the drum units 40*a* to 40*d*, the development devices 3*a* to 3*d* to the image forming apparatus 100 are also coupled.

In the configuration of the present embodiment, since the drum units 40*a* to 40*d* and the development devices 3*a* to 3*d* are moved, by the opening operation of the retainer 85, horizontally in the second direction together with the unit support tray 103, and protrude from the opening portion 101*a* of the front surface-side frame 101, the end portions of the drum units 40*a* to 40*d* and the development devices 3*a* to 3*d* are easily grasped and removed. Hence, the drum units 40*a* to 40*d* and the development devices 3*a* to 3*d* are easily accessed, and thus it is possible to smoothly perform a maintenance operation and a replacement operation on the drum units 40*a* to 40*d* and the development devices 3*a* to 3*d*.

The retainer 85 is only opened and closed, and thus the drum units 40*a* to 40*d*, the development devices 3*a* to 3*d* and the developer collection mechanism 90 in the vicinity of the back surface-side frame 102, the development devices 3*a* to 3*d* and the containers 4*a* to 4*d* and the drawer connectors 97 electrically connecting the drum units 40*a* to 40*d* and the development devices 3*a* to 3*d* and the main body of the image forming apparatus 100 are coupled or the coupling is cancelled. Thus, it is possible to stably perform the operation of coupling the development devices 3*a* to 3*d* and the drum units 40*a* to 40*d* to the main body of the image forming apparatus 100 or the operation of cancelling the coupling, with the result that the image forming apparatus 100 in which its configuration is simple and its operability is excellent is achieved.

Furthermore, since as the drum units 40*a* to 40*d* and the development devices 3*a* to 3*d* to the developer collection mechanism 90 are coupled or the coupling is cancelled, the toner discharge port 69 and the developer discharge port 83 are closed and opened by the first shutter member 65 and the second shutter member 80, it is possible to reliably prevent the toner or the developer from leaking from the toner discharge port 69 and the developer discharge port 83. Since as the development devices 3*a* to 3*d* and the containers 4*a* to 4*d* are coupled or the coupling is cancelled, the developer feed port 50*a* and the developer supply port 93 are respectively opened and closed by the feed port shutter 51 and the supply port shutter 95, it is possible to reliably prevent the developer from leaking from the developer feed port 50*a* and the developer supply port 93.

The present disclosure is not limited to the embodiment described above, and various modifications are possible without departing from the spirit of the present disclosure. For example, although in the embodiment described above, the development devices 3*a* to 3*d* are used in which a new amount of developer containing the magnetic carrier and the toner is fed, and in which a surplus amount of developer is discharged from the developer discharge portion 50*e*, development devices can be used in which the developer discharge portion 50*e* is not included and only the toner is fed. In this case, the second coupling portion 91*b* that couples the developer discharge portion 50*e* and the developer collection mechanism 90 is not necessary.

Although in the embodiment described above, the two-component development-type development devices 3*a* to 3*d* are used in which the magnetic brash formed on the outer circumferential surface of the magnetic roller 27 is used to develop the electrostatic latent images on the photoconductive drums 1*a* to 1*d*, the present disclosure is not limited to this configuration. As the development devices 3*a* to 3*d*, development devices may be used that have a development method in which a development roller where a toner layer is formed with a magnetic brash formed on the magnetic roller 27 is provided between the magnetic roller 27 and the photoconductive drums 1*a* to 1*d*, and in which the toner on the development roller is made to fly toward the photoconductive drums 1*a* to 1*d*. Alternatively, development devices using a magnetic one-component developer may be used.

The present disclosure is not limited to the color printer shown in FIG. 1, and can also be applied to other image forming apparatuses such as a monochrome printer, a monochrome and color copying machine and a digital multi-functional machine (which has various functions of a copying machine, a facsimile machine, a scanner and the like and which is also called a MFP (multi-functional peripheral)).

The present disclosure can be utilized for image forming apparatuses including a development device and an image carrying member unit that are removable. By utilization of the present disclosure, it is possible to provide an image forming apparatus which smoothly and reliably can couple a development device or an image carrying member unit to the main body of the image forming apparatus or can cancel the coupling when the development device or the image carrying member unit is inserted and removed, and in which the insertion and removal of the development device or the image carrying member unit into and from the main body of the image forming apparatus are easy and its operability is excellent.

What is claimed is:

1. An image forming apparatus comprising:

an image carrying member unit which includes an image carrying member, a cleaning device that removes a toner left on the image carrying member and a toner discharge portion that discharges the toner from the cleaning device and which is configured to be inserted with respect to a main body of the image forming apparatus with one end of the image carrying member unit in a longitudinal direction thereof first and removed with respect to the main body of the image forming apparatus with another end of the image carrying member unit in the longitudinal direction thereof first;

a development device which includes a developer carrying member that supplies the toner onto the image carrying member, which is arranged adjacent to the image carrying member unit, and which is configured to be inserted with respect to the main body of the image forming apparatus with one end of the development device in a longitudinal direction thereof first and removed with respect to the main body of the image forming apparatus with another end of the development device in the longitudinal direction thereof first;

a developer collection mechanism which is arranged on a downstream side in a first direction in which the development device and the image carrying member unit are inserted with respect to the main body of the image forming apparatus and to which the toner discharge portion that protrudes from the one end of the image carrying member unit in the longitudinal direction is coupled; and a unit support tray which is provided such that the unit support tray is movable horizontally in the first direction and a second direction in which the development device and the image carrying member unit are removed from the main body of the image forming apparatus and which individually and removably supports the image carrying member unit and the development device, wherein the unit support tray is moved in the first direction such that the toner discharge portion moves in a direction approaching the developer collection mechanism and the toner discharge portion and the developer collection mechanism are coupled whereas the unit support tray is moved in the second direction such that the toner discharge portion moves in a direction away from the developer collection mechanism and the coupling between the toner discharge portion and the developer collection mechanism is cancelled.

2. The image forming apparatus of claim 1, wherein a retainer which is arranged on an upstream side in the first direction and which is openable and closeable in an up/down direction by being pivoted about a lower end portion and a link member which couples the retainer and the unit support tray are provided, and the unit support tray is moved in the first direction or the second direction as the retainer is opened or closed.

3. The image forming apparatus of claim 1, wherein a first shutter member which opens and closes the toner discharge portion is provided, and the unit support tray is moved in the first direction such that the first shutter member opens the toner discharge portion whereas the unit support tray is moved in the second direction such that the first shutter member closes the toner discharge portion.

4. The image forming apparatus of claim 3, wherein a first force application member is arranged which applies, to the first shutter member, a force acting in a direction in which the toner discharge portion is closed.

5. The image forming apparatus of claim 1, wherein the development device includes a developer discharge portion which protrudes from the one end of the development device in the longitudinal direction and which is coupled to the developer collection mechanism, and the unit support tray is moved in the first direction such that the developer discharge portion and the developer collection mechanism are coupled whereas the unit support tray is moved in the second direction such that the coupling between the developer discharge portion and the developer collection mechanism is cancelled.

6. The image forming apparatus of claim 5, wherein a second shutter member which opens and closes the developer discharge portion is provided, and the unit support tray is moved in the first direction such that the second shutter member opens the developer discharge portion whereas the unit support tray is moved in the second direction such that the second shutter member closes the developer discharge portion.

7. The image forming apparatus of claim 6, wherein a second force application member is arranged which applies, to the second shutter member, a force acting in a direction in which the developer discharge portion is closed.

8. The image forming apparatus of claim 1, wherein a container which has a supply port coupled to a feed port of the development device and which supplies the toner from the supply port to the development device through the feed port is included, in the development device, a feed port shutter which closes the feed port is provided and in the container, a supply port shutter which opens and closes the supply port is provided, and the unit support tray is moved in the first direction such that the feed port shutter opens the feed port and the supply port shutter opens the toner supply port whereas the unit support tray is moved in the second direction such that the feed port shutter closes the feed port and the supply port shutter closes the toner supply port.

9. The image forming apparatus of claim 1, wherein a drawer connector for electrically connecting the image carrying member unit and the development device to the main body of the image forming apparatus is provided on a downstream side in the first direction, and the unit support tray is moved in the first direction such that the drawer connector is coupled whereas the unit support tray is moved in the second direction such that the coupling of the drawer connector is cancelled.

10. The image forming apparatus of claim 1, wherein on the unit support tray, a first rib which serves as a guide member when the image carrying member unit is inserted or removed and a second rib which serves as a guide member when the development device is inserted or removed are formed, and the second rib is inclined so as to be moved away from the first rib in the second direction.

11. The image forming apparatus of claim 1, wherein a plurality of the image carrying member units and a plurality of the development devices are provided according to toners of different colors, and are arranged in corresponding positions on the unit support tray.

12. The image forming apparatus of claim 1, wherein the image carrying member unit and the development device include a lock mechanism which individually retains a state where the image carrying member unit is fitted to the unit support tray and a state where the development device is fitted to the unit support tray and which can cancel the retainment.

* * * * *